US005578993A

United States Patent [19]

Sitabkhan et al.

[11] Patent Number: 5,578,993

[45] Date of Patent: Nov. 26, 1996

[54] TEMPERATURE COMPENSATED ANNUNCIATOR

[75] Inventors: Abdul N. Sitabkhan, Arcadia; James W. Tseng, La Canada, both of Calif.

[73] Assignees: Autronics Corporation, Arcadia; Mass Systems Inc., Baldwin Park, both of Calif.

[21] Appl. No.: 345,929

[22] Filed: Nov. 28, 1994

[51] Int. Cl.[6] ..... G08B 21/00

[52] U.S. Cl. ..... 340/614; 340/605; 340/501; 340/514; 340/522; 340/626; 340/592; 73/149; 73/49.2; 374/143; 364/571.03; 364/571.04; 364/571.07

[58] Field of Search ..... 340/614, 605, 340/612, 622, 626, 591, 592, 501, 521, 511, 522, 588, 589, 514; 374/141, 142, 143; 73/49.2, 53.04, 56.06, 56.09, 149; 364/571.02, 571.03, 571.04, 521.07, 557, 558

[56] References Cited

U.S. PATENT DOCUMENTS

| | | | |
|---|---|---|---|
| 3,790,910 | 2/1974 | McCormack | 364/558 |
| 4,267,890 | 5/1981 | Myers et al. | 169/75 |
| 4,289,207 | 9/1981 | Wernert | 169/30 |
| 4,351,394 | 9/1982 | Enk | 169/61 |
| 4,399,515 | 8/1983 | Gross | 364/521.04 |
| 4,489,305 | 12/1984 | Lang et al. | 340/459 |
| 4,644,482 | 2/1987 | Juanarena | 364/558 |
| 4,689,999 | 9/1987 | Shkedi | 73/703 |
| 4,697,643 | 10/1987 | Sassier | 169/23 |
| 4,763,063 | 8/1988 | Shkedi | 324/685 |
| 4,766,557 | 8/1988 | Twerdochlib | 340/605 |
| 4,852,054 | 7/1989 | Mastandrea | 340/605 |
| 5,079,707 | 1/1992 | Bird et al. | 364/424.04 |
| 5,183,116 | 2/1993 | Fleming | 169/43 |
| 5,239,865 | 8/1993 | Salzer et al. | 340/585 |
| 5,307,681 | 5/1994 | Phelps et al. | 73/708 |

OTHER PUBLICATIONS

"Simple pressure switches comprise transducers, comparators, and op amps", by E. Jacobson et al., EDN Apr. 14, 1994.

*Primary Examiner*—Jeffery Hopsass
*Assistant Examiner*—Benjamin C. Lee
*Attorney, Agent, or Firm*—Price, Gess & Ubell

[57] ABSTRACT

A solid state temperature compensated annunciator is disclosed. The solid state temperature compensated annunciator includes a pressure sensor for measuring a pressure of the fillant within a vessel and a temperature sensor for measuring the temperature of the fillant within the vessel. The solid state temperature compensated annunciator determines a pressure that the vessel would have if the vessel were filled with a predetermined amount of fillant, and compares the measured pressure to the determined pressure. If the measured pressure is below the determined pressure, a warning signal is issued.

5 Claims, 4 Drawing Sheets

AGENT PRESSURE
3000
2000
1000
800
FILL POINT
-100
0
70
100
200
300
400
AGENT TEMP. (°F)
10
12
14

18
20
200

206
208
202
201
210
212
203
204
PASS
LOW BATT
FAIL
TEST 214
216
213
212
210

226
222
228
224
220
218

TEMPERATURE COMPENSATED ANNUNCIATOR

BACKGROUND OF THE INVENTION

1. Field of the Invention

The present invention is directed to an apparatus for measuring leakage of fillant, particularly mixtures of fluids, liquids, and gases, from a pressurized vessel and, more particularly, to a temperature compensated annunciator comprised predominantly of solid state elements.

2. Description of Related Art

Maintaining adequate quantities of fillants in pressurized vessels is necessary to ensure proper operation of the pressurized vessels. A fire suppression system (fire extinguisher) on board an aircraft must be maintained in a ready condition so that the system can function optimally in the event of an emergency. Similarly, a pressurized vessel for inflating an escape slide on the aircraft to enable emergency evacuation must always have an adequate amount of fillant to function properly.

Both of these types of pressurized vessels are stored for long periods of time during which the amounts of fillant therein may decrease. A vessel that is not used for five years may be needed in an emergency and, for that one point in time, it is imperative that the amount of fillant be above the minimum design level for that system.

Accordingly, a problem exists in the prior art of keeping these vessels adequately filled for optimal operation during an emergency. A solution of the prior art is to balance the internal pressure of the extinguisher against a comparable pressure curve using similar fillant. If leakage occurs, the internal pressure of the extinguisher unbalances a mechanism, which indicates an add-fillant condition. The add-fillant condition indicates that the pressure in the vessel has dropped below an acceptable level and that fillant must therefore be added.

Fire extinguisher vessels are always subject to varying temperatures, which affects their pressure. Due to installations which vary from aircraft to aircraft, these vessels can be located in the wheel well, cargo holds, engine nacelles, wing roots, etc. The temperature after a flight can be anywhere from −65° F. to +200° F. By merely observing the pressure level of the container with a pressure gauge, the operator is unable to accurately determine the exact status of the container, since the pressure varies with temperature. An accurate determination of the pressure vessel condition can only occur if both parameters of pressure and temperature are known. The discussions below are provided for a fire extinguisher with Halon 1301 and nitrogen pressurized to 600 psi at 70° F.

A first conventional apparatus for monitoring the fillant in a fire extinguisher vessel includes a pressure gauge. The pressure gauge is a mechanical or electronic device capable of pressure readout. Since temperature can vary substantially, the correct fillant reading is at most a guess on the operator's part. Systems utilizing these pressure gauges must be removed at various intervals from the aircraft for weight checks to ensure reliability. The weight check method for these types of vessels is the only accurate determination of status. This procedure consumes time and money.

Another conventional apparatus is the mechanical pressure switch, which can accurately issue a warning at a preset pressure range only. The actuation envelope of such a conventional switch may cover a range of pressures from 250 pounds per square inch gauge (psig) to 400 psig, for example. The contacts of this switch open at 400 psig and close at 250 psig. Ideally, the mechanical switch should indicate when the contents of the vessel are less than 90% full, for example, at any given temperature, but is not capable of this function. A fully charged extinguisher, when exposed to −65° F., has a pressure level of approximately 300 psig. To avoid false warnings being issued in flight or on the ground, the mechanical switch must be set at a very low setting (for example, 250 psig). A typical fire extinguisher vessel, which may have a pressure of 500 psig when full at a temperature of 40° F., can leak more than half of its fillant before the pressure will drop below 250 psig and the switch provides a warning.

If this same fire extinguisher vessel is at 100° F., for example, even more fillant must escape before the pressure drops below 250 psig at 100° F. in order to sound the alarm. At 100° F., a 250-psig reading may correspond to the fire extinguisher vessel being only 35% full. Therefore, the conventional switch cannot accurately indicate the contents of the vessel at different temperatures, since substantial leakage must occur at most temperatures before an alarm can be sounded by the mechanical switch. Systems utilizing mechanical switches must be removed for frequent weight checks to verify system integrity, hence costing the operator time and money.

A third approach in the prior art involves a mechanical temperature compensated switch. This approach is disclosed in U.S. Pat. Nos. 3,735,376 and 3,946,175. This approach utilizes a reference chamber, bellows, and a mechanical linkage to actuate a magnetic reed switch outside of the pressurized chamber. The fillant inside the reference chamber is placed therein at a filling density similar to that of the fillant density in the pressurized chamber. Accordingly, the pressures between the reference chamber and the fire extinguisher pressurized vessel are close when there is no leak in either vessel. When a leak occurs in the fire extinguisher vessel, the pressure in that vessel decreases. The relative increase in pressure of the reference chamber causes the mechanical temperature compensated switch to issue an alarm.

The mechanical temperature compensated switch is comprised predominantly of mechanical parts which may fail. Additionally, the reference chamber must be filled with the same fillant density and amount of gas as the fire extinguisher pressurized vessel. Differences in either of these parameters result in inaccuracies. Although the mechanical temperature compensated switch can issue a warning signal at any temperature when the amount of fillant drops, the mechanical temperature compensated switch only signals after a complete no-go condition has been reached, resulting in an Aircraft-On-Ground (AOG) condition. An AOG condition requires that the aircraft remain on ground until the fire extinguisher vessel is replaced. Fire extinguisher vessel replacements are expensive, and age dated inventories of these vessels must be kept for AOG conditions that cannot be predicted.

Another drawback of the mechanical temperature compensated switch occurs when a fire extinguisher vessel is rehydrotested, as required by Department of Transportation regulations. Hydrotesting of a fire extinguisher vessel involves introduction of water into the vessel to test the integrity of the walls of that vessel. After rehydrotesting, the mechanical temperature compensated switch may be contaminated with water, and this water may subsequently freeze the switch during cold temperatures. Consequently, the mechanical temperature compensated switch must be removed from its welded condition before rehydrotesting can be performed. This involves substantial cost.

Another problem associated with the mechanical compensated switch is that the switch cannot be conveniently and reliably checked for accuracy, since the amount of fillant in the reference chamber cannot easily be monitored. A mechanical press-to-test mechanism only verifies reed switch actuation. Many mechanical parts in the mechanical temperature compensated annunciator can lead to corrosion and malfunction. Additionally, if the fill density of the fire extinguisher vessel is to be changed, the fill density of the reference chamber must also be changed. Thus, the fill density of the reference chamber must be charged to match each new fill density of the fire extinguisher vessel.

OBJECTS AND SUMMARY OF THE INVENTION

The solid state temperature compensated annunciator of the present invention includes a solid state pressure transducer and a solid state temperature sensor. These two elements output pressure and temperature signals which are fed to a data processing and interface unit. The data processing and interface unit compares the measured pressure with a pressure that would occur if a percentage of fillant in the vessel being monitored has escaped. Since the pressure of fillant in the vessel depends on temperature, the temperature inside the vessel is used to determine the pressure that would exist in the vessel if a percentage of the fillant had escaped.

Unlike the mechanical temperature compensated switch of the prior art, the solid state temperature compensated annunciator can provide high reliability with no moving members. The only contact with the fillant in the vessel is a stainless steel or titanium diaphragm, adapted for the specific media. The absence of moving parts of the solid state temperature compensated annunciator allows the switch to undergo periodic hydrotesting without removal from the pressurized vessel. This results in tremendous cost savings to the operator and/or user.

A key difference between the solid state temperature compensated annunciator and the prior art is the fact that the methodology of the present invention uses actual measurements of pressure and temperature. These actual measurements are compared to theoretical "no-go" conditions. This concept makes it usable in unlimited combinations of liquids/fluids/gases, especially when phase transformations of liquids to gases and vice versa are taking place.

It is this key feature of "measurement" that allows for forecast and trend analysis described in the paragraph below.

In contrast to the mechanical temperature compensated switch, the solid state temperature compensated annunciator of the present invention is capable of trend and forecast analysis. With the use of an auxiliary device, the solid state temperature compensated annunciator is capable of establishing a "leakage trend" indication and of actually forecasting the "life left" of a pressurized vessel before an unacceptable amount of fillant remains. This feature eliminates any need for removal of the pressure vessel containing the solid state temperature compensated annunciator from the aircraft or other inaccessible areas for weight check purposes.

Since the solid state temperature compensated annunciator has few moving parts and is compact, the solid state temperature sensors and pressure transducers of the switch can be packaged to fit a variety of receptacles, including pressure containers, valves, other ports, etc. where mounting room is at a minimum. The solid state sensors can then communicate with a data processing and interface unit at a remote location. A number of solid state temperature compensated annunciators can be used to monitor pressurized vessels in various remote locations, wherein the various sensors are connected to a common monitoring unit in a convenient location. These sensors can communicate from their remote ground installations via any conventional communication medium, such as a modem. The convenient monitoring station for tracking the status of a number of pressurized vessels in remote locations provides additional cost savings.

Whereas the mechanical temperature compensated switch could not be easily adapted to different fill densities and different fillants, the electronics of the solid state temperature compensated annunciator of the present invention can be designed to accommodate these different fillants with relative ease. For example, the values of a few resistors in the circuitry can be replaced with resistors having different values to accommodate the different fillants.

Another advantage of the present invention is the "press-to-test" feature. This testing mechanism can be conveniently implemented from a remote location. The press-to-test feature establishes the reliability of the solid state temperature compensated annunciator and the integrity of the pressurized vessel without any need for physically accessing the pressurized vessel.

The "press-to-test" switch, in addition to verifying the electronic circuitry, does provide an exact status of the pressure vessel upon actuation.

Failure in the press-to-test mode indicates a pressure vessel failure and/or an annunciator failure.

The solid state temperature compensated annunciator includes a pressure sensor for measuring a pressure of the fillant within a vessel and a temperature sensor for measuring the temperature of the fillant within the vessel. The solid state temperature compensated annunciator determines the correct pressure that the vessel would have if the vessel were filled with a predetermined amount of fillant, and compares the measured pressure to the correct pressure. If the measured pressure is below the correct pressure, a warning signal is issued.

The present invention provides a control system for monitoring the parameters of a pressurized vessel to accurately predict any leakage of fillant from the pressurized vessel, especially when fillant changes phase with temperature. The control system includes first judging circuitry for determining whether the measured pressure is below a pressure that corresponds to the vessel being only partially full regardless of temperature, a storage unit for storing the measured pressure, and comparing circuitry for comparing the measured pressure with a previously-stored correct pressure. Second judging circuitry is provided for judging whether the measured pressure is below the previously-stored correct pressure. Forecast circuitry is also provided. If the second judging circuitry judges that the measured pressure is below a previously-stored measured pressure, a time at which the amount of fillant in the vessel will fall below the pressure that corresponds to the vessel being only partially full is predicted.

According to the present invention, all of the components of the annunciator are packaged into a steel housing adapted to fit into a pressurized vessel. The first portion of the housing, the cap, extends outwardly from the surface of the pressure vessel, and a second portion, the stem extends into the interior of the pressurized vessel. The stem holds a temperature sensor for measuring a temperature of the interior of the pressurized vessel, preferably in the liquid portion, if the fillant is a liquid. The temperature sensor is shielded from eternal temperature by the cap and is thus able to closely track the temperature of the interior of the pressurized vessel.

BRIEF DESCRIPTION OF THE DRAWINGS

The objects and features of the present invention, which are believed to be novel, are set forth with particularity in the appended claims. The present invention, both as to its organization and manner of operation, together with further objects and advantages, may best be understood by reference to the following description, taken in connection with the accompanying drawings.

FIG. 7 illustrates an alternative embodiment of the solid state temperature compensated annunciator for use in monitoring the pressure for a vessel used to inflate an escape slide;

DETAILED DESCRIPTION OF THE PREFERRED EMBODIMENTS

The following description is provided to enable any person skilled in the art to make and use the invention and sets forth the best modes contemplated by the inventors of carrying out their invention. Various modifications, however, will remain readily apparent to those skilled in the art, since the generic principles of the present invention have been defined herein specifically.

Figures 1, 6, 7A, 7B, 8:
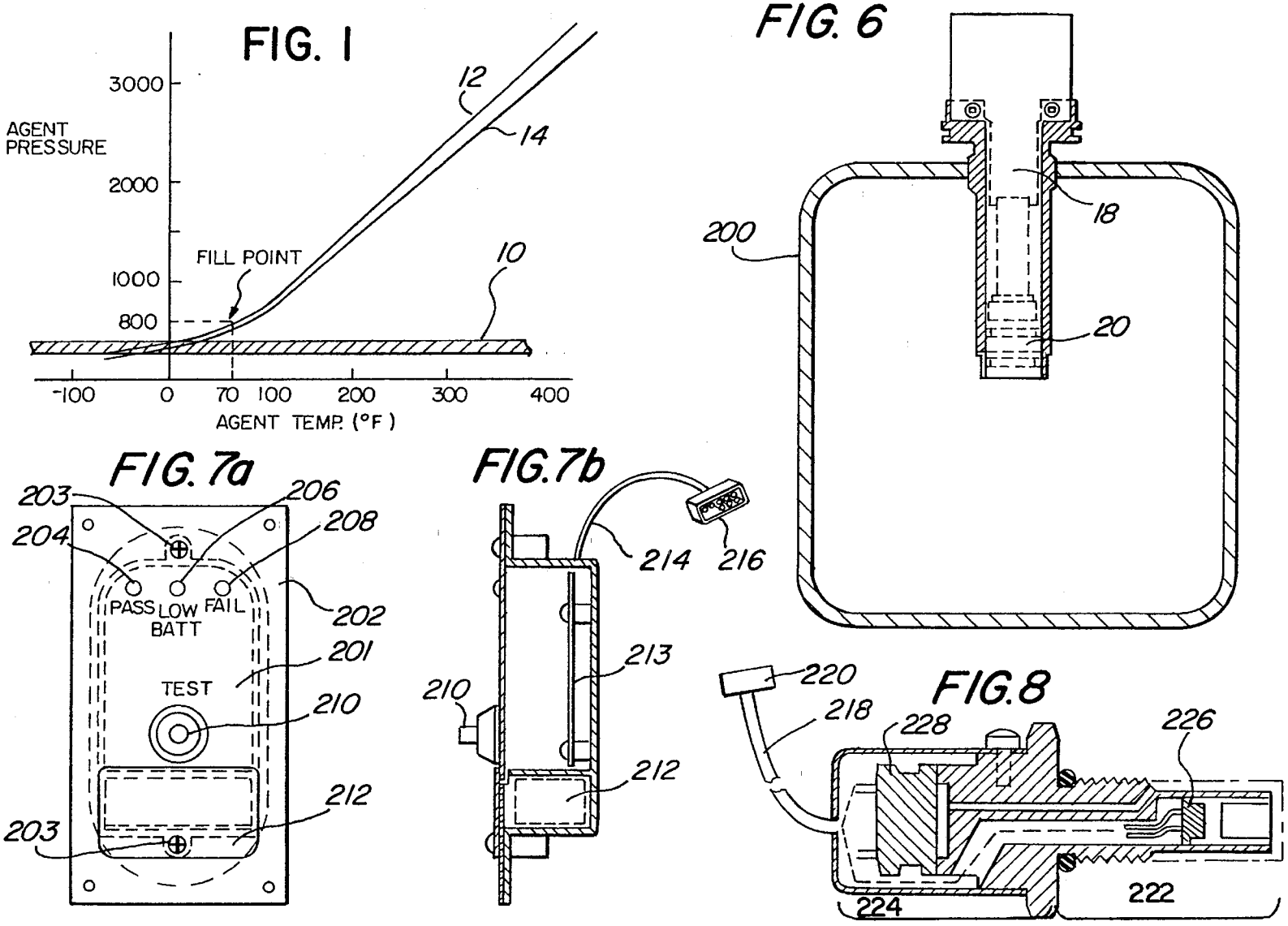
FIG. 1 is a pressure-versus-temperature curve for a typical fillant used in a fire extinguisher.
FIG. 6 is a cross-sectional view of the housing for the solid state temperature compensated annunciator of the presently preferred embodiment.
FIG. 8 is a cross-sectional view of the housing of the solid state temperature compensated annunciator according to the alternative embodiment of the present invention.

A temperature-versus-pressure curve for the fillant inside a fire extinguisher vessel is shown in FIG. 1. Fire extinguisher vessels used on aircraft are subjected to extremely variable temperatures, depending on the site, time, and altitude. The pressure of the fillant inside the pressurized vessel varies with temperature, and is subject to complex thermodynamic law. A typical fire extinguisher comprises a propellant agent and a fire fighting agent. Typically, the propellant agent is nitrogen and the fire fighting agent is Halon 1301. It is noted that Halon 1301 is scheduled to be replaced due to ozone depletion. Newer replacement agents may have different characteristics than the presently preferred embodiment using Halon 1301, but can be implemented without deviating from the scope of the present invention.

As shown in FIG. 1, the fillant pressure can vary from 300 psig to over 1500 psig in a temperature range of −65° F. to over +200° F. At around 70° F., the fillant pressure is around 600 psig, and at around 200° F., the pressure climbs to approximately 1500 psig. Thus, the pressure of the fillant varies greatly with temperature, even though the amount and volume of the fillant is fixed within the vessel. This mixture also does not follow the conventional gas laws as phase and density changes are occurring within the vessel.

A conventional switch actuation envelope is shown at 10. A conventional switch must be set so that the contacts close at around 250 psig to prevent a false warning when the temperature falls close to −65° F. A problem exists at temperatures between ambient and higher, however, because a pressurized vessel less than 50% full of fillant will still have a pressure greater than 250 psig. Thus, the conventional switch is unable to automatically signal the occurrence of a small leak in a pressurized vessel over a wide range of temperatures.

A typical fire extinguisher charged with a mixture of Halon 1303 and nitrogen must be maintained at a minimum level of 90% of the original charged volume by pressure. The pressure-versus-temperature curve 12 in FIG. 1 shows how the pressure changes with temperature for this fillant in a pressurized vessel. The curve 12 is for a typical fill of Halon 1303 at 50 lb/ft$^3$ fill density and super pressurized with nitrogen to 600 psig at 70° F. The pressure-versus-temperature curve 14 is similar to the curve 12, but represents the behavior of a pressurized vessel filled only 90% full with the fillant by pressure. Thus, a user equipped with the curve 14 can take a pressure and temperature measurement of a fire extinguisher vessel and determine whether the fillant therein is greater than or equal to 90% of the original charge. For example, at 70° F. a pressure reading of approximately 540 psig would indicate that the fire extinguisher contains only 90% of the original charge of fillant. If the pressure at this temperature is below 540 psig, the fire extinguisher vessel must be recharged.

Figure 2:
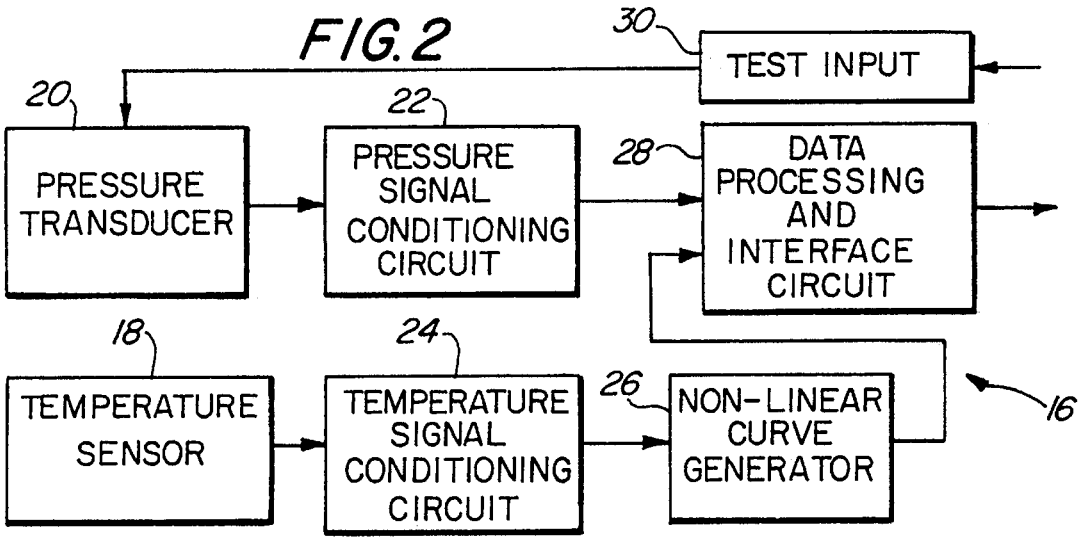
FIG. 2 is a block diagram of the solid state temperature compensated annunciator of the presently preferred embodiment.

Turning to FIG. 2, the temperature compensated annunciator 16 of the presently preferred embodiment is shown. A pressure transducer 20 comprises a conventional strain gauge or another compatible device. The pressure transducer measures the pressure within the fire extinguisher vessel. A temperature sensor 18 is used to measure the temperature of the fillant within the fire extinguisher vessel. This temperature sensor 18 can be a semiconductor device, a thermocouple, a thermistor, or some other compatible device. The pressure signal conditioning circuit 22 provides excitation power to the pressure transducer 20 and amplifies the low level pressure signal into a more manageable, higher voltage signal. Similarly, the temperature signal conditioning circuit 24 provides power to the temperature sensor 18 and also amplifies the temperature signal from the temperature sensor 18 into a more manageable, higher voltage signal.

The nonlinear curve generator 26 generates a curve similar to the pressure-versus-temperature curve 14 in FIG. 1. Thus, a temperature output from the temperature sensor 18 is conditioned by the temperature signal conditioning circuit 24, and is fed into the nonlinear curve generator 26 in order to output a pressure value which lies along the curve 14 (FIG. 1). The pressure value outputted from the nonlinear curve generator 26 represents a minimum pressure that the fire extinguisher vessel can have to be properly operational at that particular temperature. If the pressure from the pressure signal conditioning circuit 22 is below the pressure output for a given temperature from the nonlinear curve generator 26, the fire extinguisher vessel must be recharged. The data processing and interface circuit 28 makes this determination.

The data processing and interface circuit 28 comprises a voltage comparator and a relay driver circuit. The comparator compares the actual pressure measured from pressure transducer 20 and conditioned by element 22 with the low pressure limit from the nonlinear curve generator 26 and energizes a relay when the actual pressure is below the lower limit for a given temperature throughout the operating range.

The test input 30 provides a testing means for ensuring correct operation of the solid state temperature compensated annunciator 16. The signal from the test input 30 artificially modifies the pressure transducer 20 excitation voltage, and causes the pressure transducer 20 to output a pressure which is lower than the low limit pressure outputted from the nonlinear curve generator 26 at a given temperature.

Figure 3:
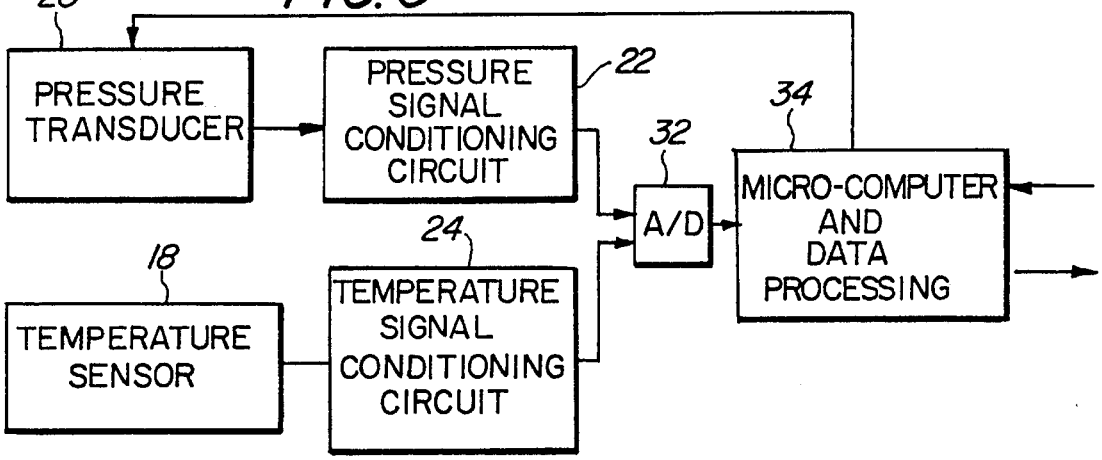
FIG. 3 is a block diagram of the presently preferred embodiment including trend analysis.

FIG. 3 is a block diagram which shows a more specific application of the solid state temperature compensated annunciator 16. The pressure transducer 20, the pressure signal conditioning circuit 22, the temperature sensor 18, and the temperature signal conditioning circuit 24 are the same as those shown in FIG. 2. The analog-to-digital converter 32 converts temperature and pressure information into digital data.

The microcomputer and data processing unit 34 comprises a microcomputer, software, and input/output interface circuits. The microcomputer can store the actual temperature and pressure data for a temperature cycle of a pressurized vessel. Thus, when the pressurized vessel goes through a temperature cycle, the computer can compare the current temperature and pressure data with stored temperature and pressure data and relay the percentage change information to the outside world. If the measured temperature and pressure data indicates an internal pressure below a predetermined level, a warning signal can be outputted. If a fine leak is discovered, but the fillant has not fallen below the predetermined level, the computer can forecast when the fillant in the pressurized vessel must be recharged based upon current leakage levels. Thus, upon detection of a fine leak, a user can determine the remaining amount of time before the pressurized vessel must be recharged.

Figure 4:
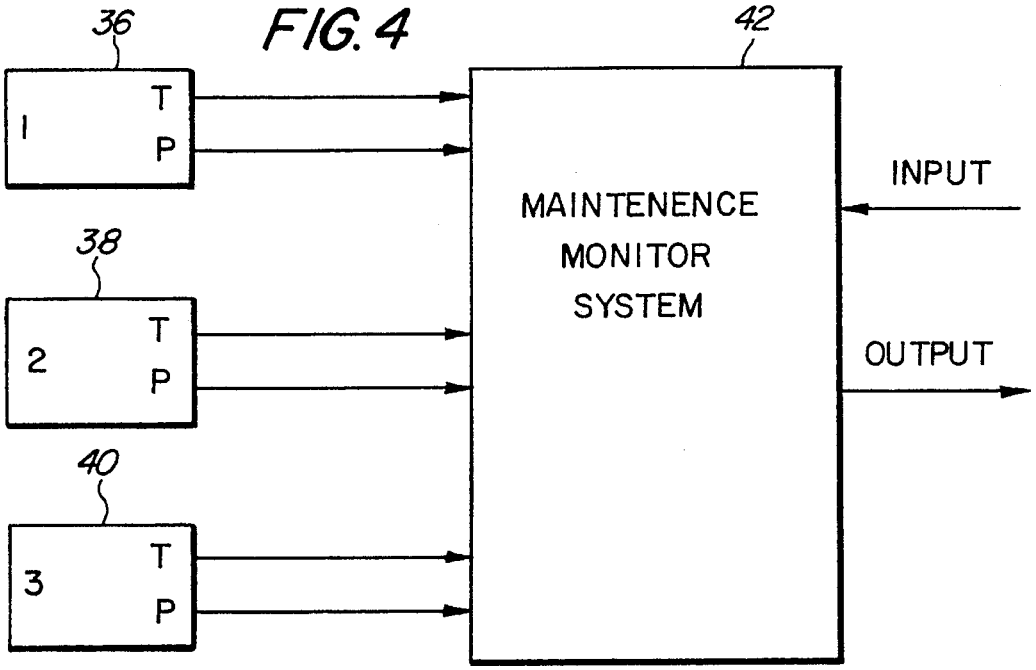
FIG. 4 is a block diagram showing a single monitoring system connected to several remote pressurized vessels.

Another implementation of the temperature compensated annunciator 16 of the present invention is shown in FIG. 4. FIG. 4 depicts a plurality of pressurized vessels, each monitored by corresponding temperature and pressure sensors. As shown, three pressurized vessels are monitored by three sets of temperature and pressure sensors 36, 38, and 40, respectively. The pressurized vessels may be located in remote areas, such as different states. A maintenance monitor system 42 is operatively connected to each of the temperature pressure sensors locally. The output information from the monitor system can be transmitted via a modem to a convenient central site.

Figure 5:
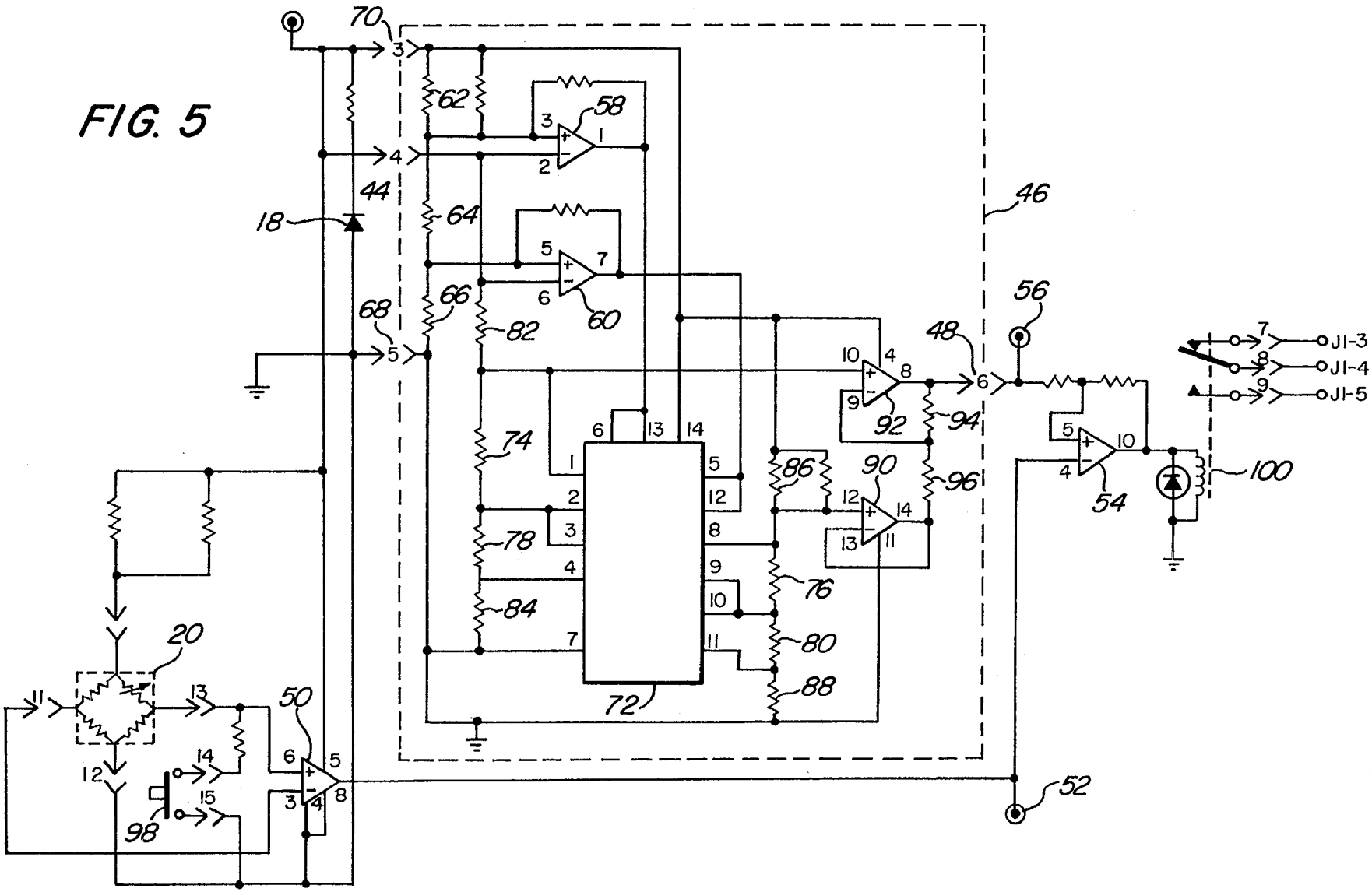
FIG. 5 is a detailed schematic showing the circuitry of the presently preferred embodiment.

The circuitry of the solid state temperature compensated annunciator 16 of the presently preferred embodiment is shown in FIG. 5. The pressure transducer 20 senses and measures the pressure of the fillant in a fire extinguisher vessel. The pressure transducer 20 is preferably a strain gauge pressure transducer. The pressure transducer 20 is welded onto the tip of the solid state temperature compensated annunciator 16 in order to come into contact with the fillant. Temperature sensor 18 comprises a diode. The output from the temperature sensor 18 enters the circuitry surrounded by a dotted line via pin 4 shown at 44. The circuitry within the dotted box takes the output from the temperature sensor 18 and plots a predicted pressure somewhere along the curve 14 shown in FIG. 1.

Since each measured temperature input from the temperature sensor 18 that is fed into the circuitry in the dotted box generates a pressure output along the line 14 of FIG. 1, the circuitry within the dotted box will be referred to as a curve generator 46. It is noted that an alternative embodiment of the present invention may comprise a curve generator that generates a temperature output in response to a measured pressure input.

In the presently preferred embodiment, the curve generator 46 generates a three-segment straight line approach to approximate the nonlinear curve 14 shown in FIG. 1. Alternatively, other straight line approaches, such as a four-segment straight line approach, may be used, or a microprocessor or programmed computer may be used. Looking at FIG. 1, a first line may be drawn along the curve 14 from the 150° F. mark to the 400° F. mark. The second line of the three-segment straight line approach may be placed on the nonlinear curve 14 from the 70° F. mark to the 150° F. mark. The final line may cover the curve from −65° F. to 70° F. Thus, each temperature input from the temperature sensor 18 is plotted on the three-segment straight line approach of the nonlinear curve 14 in order to generate a pressure output at pin 6, which is shown at 48.

Looking at the pressure transducer in FIG. 5, the amplified pressure signal of this element 20 is output from the amplifier 50 and fed to the pin 52 and the comparator amplifier 54. Since the output at pin 52 represents actual measured pressures of the fillant in the pressurized vessel at different temperatures, the outputs at this pin 52 fall along line 12 in FIG. 1, when the pressurized vessel is fully charged. Thus, for example, at a temperature of 70° F., the amplified pressure signal at pin 52 should be 600 psig when the pressurized vessel is fully charged. The predicted pressure output from the curved generator 46 can be measured at pin 56, and is also fed to the comparator amplifier 54.

The comparator 54 compares the actual measured pressure from the pressure transducer 20 with the predicted pressure from the curve generator 46 (which lies along the curve 14 for the temperature value measured by the temperature sensor 18). If the actual measured pressure at pin 52 is above the predicted pressure at pin 56, then the pressurized vessel is presumed to be sufficiently charged. If the actual measured pressure at pin 52 is equal to the predicted pressure at pin 56, then the fillant in the pressurized vessel is presumed to be at 90% of its original charge level. Finally, if the actual measured pressure at pin 52 is below the predicted pressure at pin 56, the pressurized vessel is deemed to have an insufficient amount of fillant and, accordingly, the pressurized vessel must be recharged with fillant. When the actual measured pressure 52 is below the predicted pressure at pin 56, the comparator 54 activates a relay 100 to provide a warning signal to users.

The operation of the curve generator 46 will now be described in detail. As a preliminary note, a simple straight line approach would be to take the temperature sensor 18 input at pin 44 and output the same value at pin 48. Thus, a 45-degree line would be produced. In the presently preferred embodiment, the output from the temperature sensor 18 is fed to two comparators 58 and 60. Specifically, the output from the temperature sensor 18 is fed to pin 2 of comparator 58 and to pin 6 of comparator 60. Pin 3 of the comparator 58 is connected to a voltage divider which comprises three resistors 62, 64, and 66. These three resistors 62, 64, and 66 are used to set up the two connecting points between the three straight lines which approximate the nonlinear curve 14 of FIG. 1.

Regarding this voltage divider, it is noted that pin 5 (shown at 68) of the curve generator 46 is grounded, and pin 3 (shown at 70) of the curve generator 46 is connected to a dc voltage. Although the presently preferred embodiment uses 7.15 volts dc voltage at pin 3 of the curve generator 46, a value of 3.57 kilohms for the resistor 62, a value of 876 ohms for the resistor 64, and a value of 5.56 kilohms for the resistor 66, approximate values for this voltage divider circuit will be used for the purpose of discussion. Specifically, the voltage between resistor 64 and resistor 66 will be assumed to be 3 volts, and the voltage between resistor 64 and resistor 62 will be assumed to be 5 volts.

When the temperature value from the temperature sensor 18 at pin 4 of the curve generator 46 is below 3 volts, then the outputs of comparators 58 and 60 will both be high. That is, pin 3 of the comparator 58 will have a voltage of 5 volts, and pin 2 of the comparator 58 will have a voltage less than 3 volts so that pin 1 of the comparator 58 will have a high output. Similarly, pin 5 of the comparator 60 will have a voltage of 3 volts, and pin 6 of the comparator 60 will have a voltage less than 3 volts so that pin 7 of this comparator 60 will have a high output.

These two high outputs are fed to the quad solid state switch 72. The quad solid state switch 72 comprises four switches. Pins 1 and 2 of the quad solid state switch 72 comprise a first switch which is controlled by pin 13. If pin 13 is high, pins 1 and 2 will be connected together. If pin 13 is low, pin 1 is not connected to pin 2. Pins 3 and 4 comprise a second switch, which is controlled by pin 5. The third switch comprises pins 10 and 11, and is controlled by pin 12. The fourth switch comprises pins 8 and 9, and is controlled by pin 6. The above functions can be accomplished through the use of electromechanical components.

Thus, when the output from temperature sensor 18 is less than 3 volts, the output of the comparator 58 is high, pin 13 is high, and pins 1 and 2 are connected. When pins 1 and 2 of the quad solid state switch 72 are connected, the resistor 74 is shorted. Since pin 6 is high, pins 8 and 9 are similarly connected to short the resistor 76.

Pin 7 of the comparator 60 is high and is fed to pins 5 and 12 of the quad solid state switch 72. Since pin 5 controls pins 3 and 4, pins 3 and 4 are connected together to short the resistor 78. Similarly, pin 12 is high and connects pins 10 and 11 to bypass the resistor 80. Accordingly, when the temperature sensor 18 output is less than 3 volts, the resistors 74, 78, 76, and 80 are all shorted.

Thus, the input voltage at pin 4 of the curve generator 46 is effected by only the two resistors 82 and 84. On the other side of the quad solid state switch 72, only resistors 86 and 88 establish a voltage divider which effects the voltage at pin 12 of the follower 90. The output at pin 14 of the follower 90 will be the same as the input at pin 12 of the follower 90. Another amplifier 92 accepts at pin 10 a signal which depends on the input from the temperature sensor 18 and the voltage divider which, in this example, comprises resistors 82 and 84. The amplifier 92 has a gain which is determined by resistors 94 and 96, subtracted by the "zero" established at pin 12 of the follower 90.

The four resistors 82, 74, 78, and 84 establish a ratio network which can change the slope of a given line, and the four resistors 86, 76, 80, and 88 comprise a bias network which can change the zero bias voltage. Accordingly, in the above example, a zero and a gain are established to form the first line of the three-segment straight line approximation of the curve 14.

If the output from the temperature sensor 18 is above 3 volts but less than 5 volts, then the output pin 7 of the comparator 60 will be low. Pins 5 and 12 will be low, pins 3 and 4 will be open, and pins 10 and 11 will be open. Thus, the zero bias voltage will be established by the resistors 86, 80, and 88. The ratio network for the slope will be effected by resistors 82, 78, and 84. Thus, these two networks will provide a second zero and a second slope for the second line along the curve 14.

Finally, when the output of the temperature sensor 18 is above 5 volts, pin 1 of the comparator 58 and pin 7 of the comparator 60 are both low. Pins 6 and 13 of the quad solid state switch 72 are low and, accordingly, the resistor 74 and the resistor 76 are not shorted. Accordingly, another slope is generated by the ratio network and another slope and another zero are generated to form the third line of the three-segment straight line approach for the nonlinear curve 14 of FIG. 1.

If a different fillant is used, the values of the resistors in the curve generator 46 can be changed to effect a different nonlinear curve. Additionally, a four-segment straight line approach for a nonlinear curve, or any number of straight lines, may be implemented by adding additional comparators and switches to the curve generator 46. Alternatively, the curve generator 46 may be implemented using a microcomputer and a look-up table.

A press-to-test switch 98 can be used to test the solid state temperature compensated annunciator 16. When a switch is pressed, the pressure reading from the pressure transducer 20 is artificially lowered to make the measured pressure at pin 52 lower than the predicted pressure at pin 56. This will activate the relay 100 to cause a warning signal to be issued. Alternately, a solid state switch can be utilized in lieu of a relay, depending upon output loads.

FIG. 6 shows the housing for the solid state temperature compensated annunciator 16. The housing comprises a cylindrical portion which can be inserted into the pressurized vessel 200. The cylindrical portion comprises a pressure transducer 20 and a temperature sensor 18. The temperature sensor 18 is mounted onto a circuit board, and the solid state temperature compensated annunciator electronics are located in the housing above the exterior surface of the pressurized vessel 200. The unique design of the housing allows the temperature sensor 18 to closely track the temperature of the fillant in the pressurized vessel 200. Since the temperature sensor 18 is located proximately to the fillant and is shielded from the external environment by the housing and the electronics circuitry of the solid state temperature compensated annunciator 16, the temperature sensor 18 is able to closely monitor the temperature of the fillant. Alternatively, the solid state temperature compensated annunciator electronics can be located within the pressurized vessel 200 without any significant effect on function.

The solid state temperature compensated annunciator according to an alternative embodiment can be placed in the door of an aircraft. As shown in FIG. 7, the door of the aircraft houses an inflatable escape slide which can be inflated by a pressurized vessel. The pressurized vessel in this embodiment comprises a fillant of carbon dioxide and nitrogen pressurized to 3000 pounds per square inch. This fillant would have a different pressure-versus-temperature curve than that shown in FIG. 1 for Halon 1303.

As presently preferred, this alternative embodiment comprises a front panel 201 in a plastic or aluminum enclosure.

The front panel 201 comprises mounting holes 203, LED lights 204, 206, and 208, a test switch 210, and access to a battery 212. The enclosure houses an electronics printed circuit assembly 213. The enclosure further comprises a metallic layer for electromagnetic protection. The electronics assembly 213 is further weather shielded to meet environmental requirements, and the connect cable 214 is electromagnetically shielded as well.

As presently embodied, the connector 216 (FIG. 7B) comprises a Molex connector. This connector is a six-pin connector and requires an engage force of 13.8 pounds and a disengage force of 4.8 pounds. The disengage requirement is to allow the sensor to physically separate from the display panel upon slide deployment.

The door of the aircraft accommodates the front panel 201. The test button 210 is for testing the operation of the solid state temperature compensated annunciator of this alternative embodiment. During a press-to-test sequence, the three LEDs 204, 206, and 208 light up for approximately one second to initiate a self-test of the circuitry of the solid state temperature compensated annunciator and the battery 212. Once this sequence has been initiated, only the pass LED 204 or the fail LED 208 will stay lit to indicate system status. The low battery LED 206 will stay lit only to indicate a weak cell or cells for battery replacement. As presently preferred, the pass LED 204 is green, the fail LED 208 is red, and the low battery LED 206 is amber.

This display unit comprising the LEDs 204, 206, 208, and 210 is designed to fit the cutout of existing display windows in aircraft doors, and can be mounted from the outside with a cover plate 202 or from the inside, according to preference.

A cross-section of the display unit is shown in FIG. 7B. The display unit is provided with a shielded cable 214 and a quick-disconnector 216. All of the components in this display unit are solid state, with the exception of the press-to-test switch 210, and are selected for service in the temperature range of −65° F. to +160° F.

The housing for the solid state temperature compensated annunciator of this embodiment is shown in FIG. 8. This housing is designed to fit into an existing valve cavity of the pressurized vessel. This housing is a shielded cable 218 and a quick-disconnector 220. The stem 222 of the housing is inserted inside, and the cap 224 remains above the outer surface of the pressurized vessel. The temperature sensor 226 is thus placed deep within the pressurized vessel to accurately track the temperature of the fillant therein. The pressure sensor 228 is able to track the pressure of the fillant within the pressurized vessel.

The temperature sensor 226 and the pressure transducer 228 are packaged within the housing to be introduced into the pressure port of the container valve assembly. The temperature sensor 226 is buried into the valve cavity to accurately track the fluid temperature within the valve cavity. This housing is potted to protect the temperature sensor 226 and circuitry from environmental effects.

Figure 9:
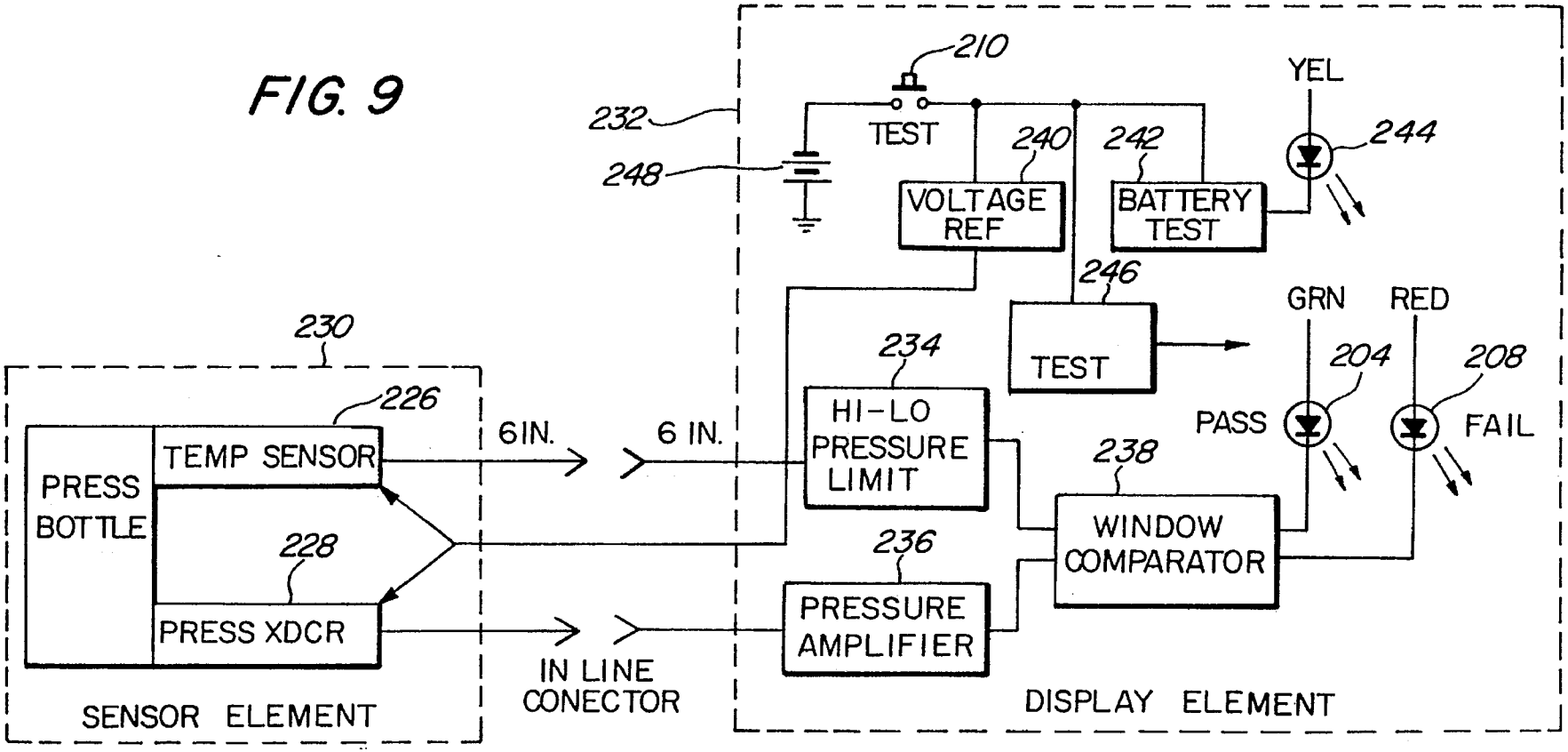
FIG. 9 is a block diagram illustrating the circuitry of the solid state temperature compensated annunciator of the alternative embodiment.

FIG. 9 is a block diagram illustrating the interconnection of the solid state temperature compensated annunciator housing and the display element. The dotted box 230 represents the pressurized vessel and the housing comprising the temperature sensor 226 and the pressure transducer 228. The housing 230 is connected to the display element 232 via an in-line connector with approximately six inches of cable from each element. The housing is configured to fit into the existing pressure gauge area, and the sensors are used to sense the pressure and temperature of the pressurized vessel.

The high/low pressure limit generator 234 generates both high and low pressure limit curves in direct proportion with the bottle temperature operating range of −65° F. to +160° F. This operation is similar to that discussed with regard to the first embodiment of the present invention. The pressure amplifier 236 amplifies the millivolt pressure signal from the pressure transducer 228 into a more manageable higher-level voltage signal.

The window comparator 238 compares the measured pressure signal with the predicted pressure signal from the high/low pressure limit generator 234 and determines whether the measured pressure is within the high/low limit window. The pass LED 204 is illuminated when the pressure from the pressure amplifier 236 is within the window of predicted pressures generated from the high/low pressure limit generator 234. If the measured pressure from the pressure amplifier 236 is outside the high/low pressure limit window from the high/low pressure limit generator 234, the fail LED 208 is illuminated.

The voltage reference generator 240 supplies power to the temperature sensor 226 and the pressure transducer 228. The battery tester 242 tests the battery 212 (FIG. 7B) to ensure that this battery is properly charged. In the event that the battery is drained below the required level for accurate indication, the low battery yellow LED 244 is illuminated.

The self-test circuit 246 turns on all lights of the display element 232 when power is applied. This circuit checks the integrity of all of the indication lights. The system is powered by a 7 to 9 volt dc battery 248. When the test switch 210 is depressed, all LEDs are illuminated for approximately one second. After one second, either the pass LED 204 or the fail LED 208 is illuminated, depending on the condition of the pressurized vessel. In the presently preferred embodiment, when the press-to-test switch 210 is released, all of the LEDs are extinguished.

Those skilled in the art will appreciate that various adaptations and modifications of the just-described preferred embodiment can be configured without departing from the scope and spirit of the invention. Therefore, it is to be understood that, within the scope of the appended claims, the invention may be practiced other than as specifically described herein.

What is claimed is:

1. A temperature compensated annunciator for monitoring an amount of fillant in a pressurized vessel comprising:

temperature sensor means for determining a temperature of said fillant and generating a temperature signal corresponding to said fillant temperature;

pressure transducer means for measuring the pressure within said pressurized vessel and generating a pressure signal corresponding to said measured pressure;

fillant amount determining means for receiving the temperature signal from said temperature sensor means and determining a calculated pressure corresponding to a minimum operational fillant level of said pressurized vessel;

judging means for judging whether said measured pressure in said pressurized vessel is below said calculated pressure corresponding to said minimum operational fillant level;

signaling means for signaling a user when said judging means judges that said measured pressure in said pressurized vessel is below said calculated pressure;

storage means for storing a value corresponding to the measured pressure;

leak detection means for determining a reduction in the amount of fillant in the vessel by comparing the pressure measured by the pressure transducer means with a previously measured pressure stored in said storage means during a given temperature cycle; and forecast means for forecasting, if said leak detection means determines a reduction in the amount of fillant, when said fillant amount will be less than said minimum operational fillant level.

2. The temperature compensated annunciator as recited in claim 1 further comprising temperature signal amplification means for receiving said temperature signal from said temperature sensor means and amplifying said temperature signal prior to communicating said temperature signal to said fillant determining means.

3. The temperature compensated annunciator as recited in claim 1 further comprising pressure signal amplification means for receiving said measured pressure signal from said pressure transducer means and amplifying said measured pressure signal prior to communicating said measured pressure signal to said fillant determining means.

4. The temperature compensated annunciator as recited in claim 1 further comprising user verification means for verifying the signaling means by artificially lowering the measured pressure signal to a value below the calculated pressure corresponding to the minimum operational fillant level thereby verifying the operation of said signaling means.

5. The temperature compensated annunciator as recited in claim 1 further comprising data transmitting means for transmitting temperature and pressure data to a remote monitoring station.

* * * * *